US005813101A

United States Patent [19]

Fehrer

[11] Patent Number: 5,813,101

[45] Date of Patent: Sep. 29, 1998

[54] DEVICE FOR NEEDLING A PREBONDED WEB

[76] Inventor: Ernst Fehrer, Auf der Gugl 28, A-4020 Linz, Austria

[21] Appl. No.: 843,674

[22] Filed: Apr. 10, 1997

[30] Foreign Application Priority Data

Apr. 19, 1996 [AT] Austria ..... 711/96
Apr. 29, 1996 [AT] Austria ..... 766/96

[51] Int. Cl.[6] ..... D04H 18/00

[52] U.S. Cl. ..... 28/114; 28/107; 28/115

[58] Field of Search ..... 28/107, 113, 114, 28/115

[56] References Cited

U.S. PATENT DOCUMENTS 3,010,178 11/1961 Rust .
4,378,618 4/1983 Dilo ..... 28/115
5,016,331 5/1991 Dilo ..... 28/115
5,551,134 9/1996 Fehrer ..... 28/115

FOREIGN PATENT DOCUMENTS 1660785 10/1970 Germany .
2263949 7/1974 Germany .

*Primary Examiner*—C. D. Crowder
*Assistant Examiner*—Larry D. Worrell, Jr.
*Attorney, Agent, or Firm*—Collard & Roe, P.C.

[57] ABSTRACT

A device for needling a prebonded web (1), comprises at least one needle board (3) reciprocatingly movable in a needling direction, and a web support (2) disposed opposite the needle board (3) between a feed roller (7) and a discharge roller (8). To avoid a stripper it is proposed that the needle board (3) be disposed directly opposite the web support (2), that the web support be provided with a continuous convex curvature in direction of web movement (6), and that the discharge rate of the discharge roller (8) exceed the feed rate of the feed roller (7).

5 Claims, 2 Drawing Sheets

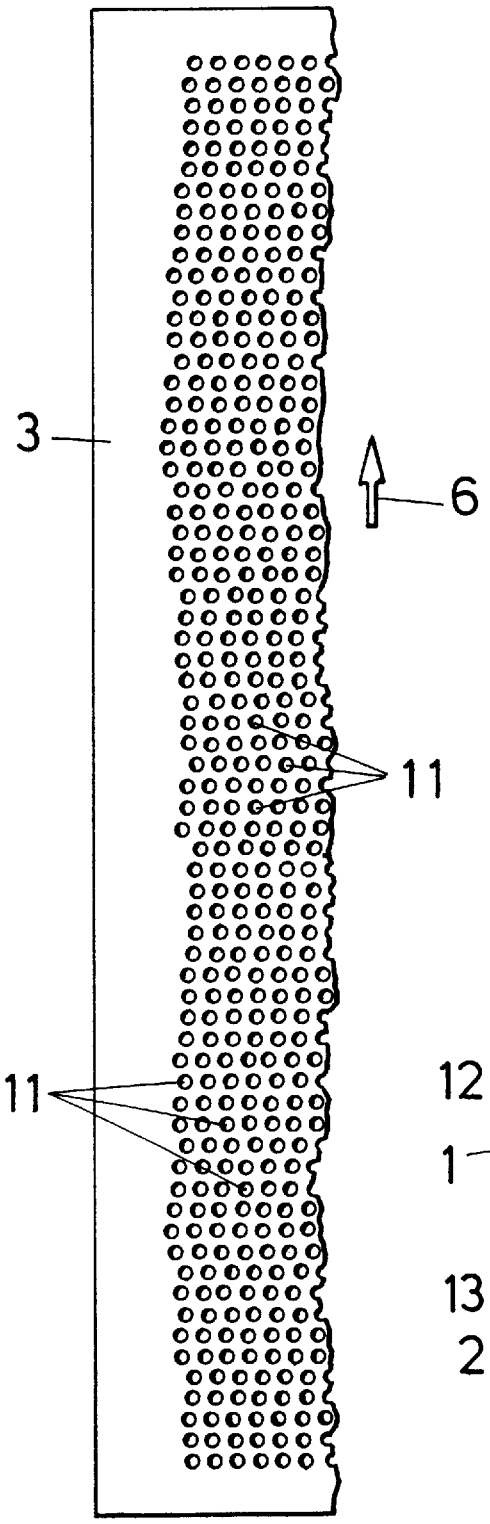
FIG.2
FIG.3
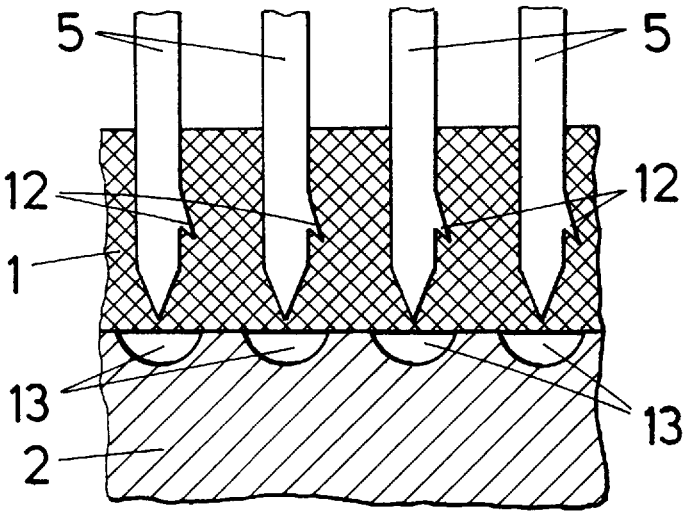

DEVICE FOR NEEDLING A PREBONDED WEB

BACKGROUND OF THE INVENTION

1. Field of the Invention

This invention relates to a device for needling a prebonded web, comprising at least one needle board reciprocatingly movable in stitching direction, and comprising a web support disposed opposite the needle board between a feed roller and a discharge roller.

2. Description of the Prior Art

In conventional devices of this kind the web is guided between the web support opposite the needle board and a stripper between the web support and the needle board, whose needles stitch into the web through penetration holes in the stripper. The stripper, which like the web support mostly consists of a perforated plate, has the function of enabling the smooth withdrawal of the needles from the web, which without such stripper would not be completely released by the needles, because the barbs of the needles required for the entrainment of the fibers might at least partly lift the web unimpededly. However, needles that remain in engagement with the web naturally impede the feed of the web significantly. Despite the considerable effort for the stripper provided with holes corresponding to the needle pitch, which stripper should not only meet certain strength requirements, but should also be adjustable in stitching direction for adaptation to the web thickness, such stripper can therefore not be omitted in the known needling devices.

SUMMARY OF THE INVENTION

It is therefore the object underlying the invention to improve a device for needling a prebonded web as described above such that a stripper can be omitted without impairing the withdrawal of the needles from the web and without disturbing the web feed.

This object is solved by the invention in that the needle board is disposed directly opposite the web support, which has a continuous convex curvature in direction of web movement, and that the withdrawal speed of the discharge roller exceeds the conveying speed of the feed roller.

For omitting a conventional stripper between the web support and the needle board, the web must be urged against the web support against the withdrawal resistance of the needles. For this purpose, the web support is provided with a continuous convex curvature, and the web is subjected to a corresponding tensile stress, which due to the convex curvature of the web support urges the web against the web support, so that the needles can easily be withdrawn from the web. The tensile stress acting on the web is easily achieved by means of the feed roller and the discharge roller, when these roller pairs are driven with a corresponding difference in speed. For subjecting the web to a corresponding tensile stress it is of course necessary that the web has a corresponding longitudinal strength, which is the case with the usual prebonded webs.

To ensure a close fit of the web also in the feed and discharge portions of the web support, the web should not be guided in the tangential inlet and outlet planes of the web support. For this purpose, the surfaces of web movement between the web support on the one hand and the feed roller and the discharge roller on the other hand should rather be inclined away from the tangential inlet and outlet planes of the web support on the side facing away from the needle board, so that the web is deflected at the inlet and outlet edges of the web support, which ensures a close fit of the web also in the inlet and outlet portions.

The omission of a conventional stripper in addition offers the possibility of providing the needle board with at least one needle area extending over the working width and disposed directly opposite the web support, which needle area has a minimum number of five needles, preferably eight needles per $cm^2$, each inserted in a separate bore. Since with increasing density of the needle distribution the rate of felting increases on the one hand, and the dependence of the stitch pattern on the feed rate of the web decreases in the course of needling, particularly favorable conditions can be created in the case of a correspondingly high needle density over the working width both in terms of bonding and also with respect to a uniform stitch density, which is independent of the respective web feed. A needle density high enough for this purpose can, however, only be realized constructively when a stripper between the needle board and the web support does not become necessary, as only then the restriction of the mutual needle distance by the distance of the holes in the stripper is cancelled. The mutual minimum distance of the needles thus merely depends on the strength conditions in the area of the needle board, which provides for high enough needle densities. To ensure a corresponding effect, the needle board may be fitted with a minimum number of five needles per $cm^2$ in a needle area extending over the working width. More favorable conditions are of course obtained when the minimum number is increased to eight needles per $cm^2$ and above.

The higher needle density of the needle board of course also prevents that the web support is designed as usual as a perforated plate. To nevertheless ensure a piercing of the web, the web support may have surface indentations in the area of needle extension, which do not impair the strength of the web support.

BRIEF DESCRIPTION OF THE DRAWING

In the drawing, the subject-matter of the invention is represented by way of example, wherein:

FIG. 2 represents segments of an embodiment of a needle board for the inventive device in a top view on the receiving holes for the needles on an enlarged scale, and FIG. 3 represents a longitudinal section through a web support with the needles stitching into the web, on an enlarged scale.

DESCRIPTION OF THE PREFERRED EMBODIMENTS

Figure 1:
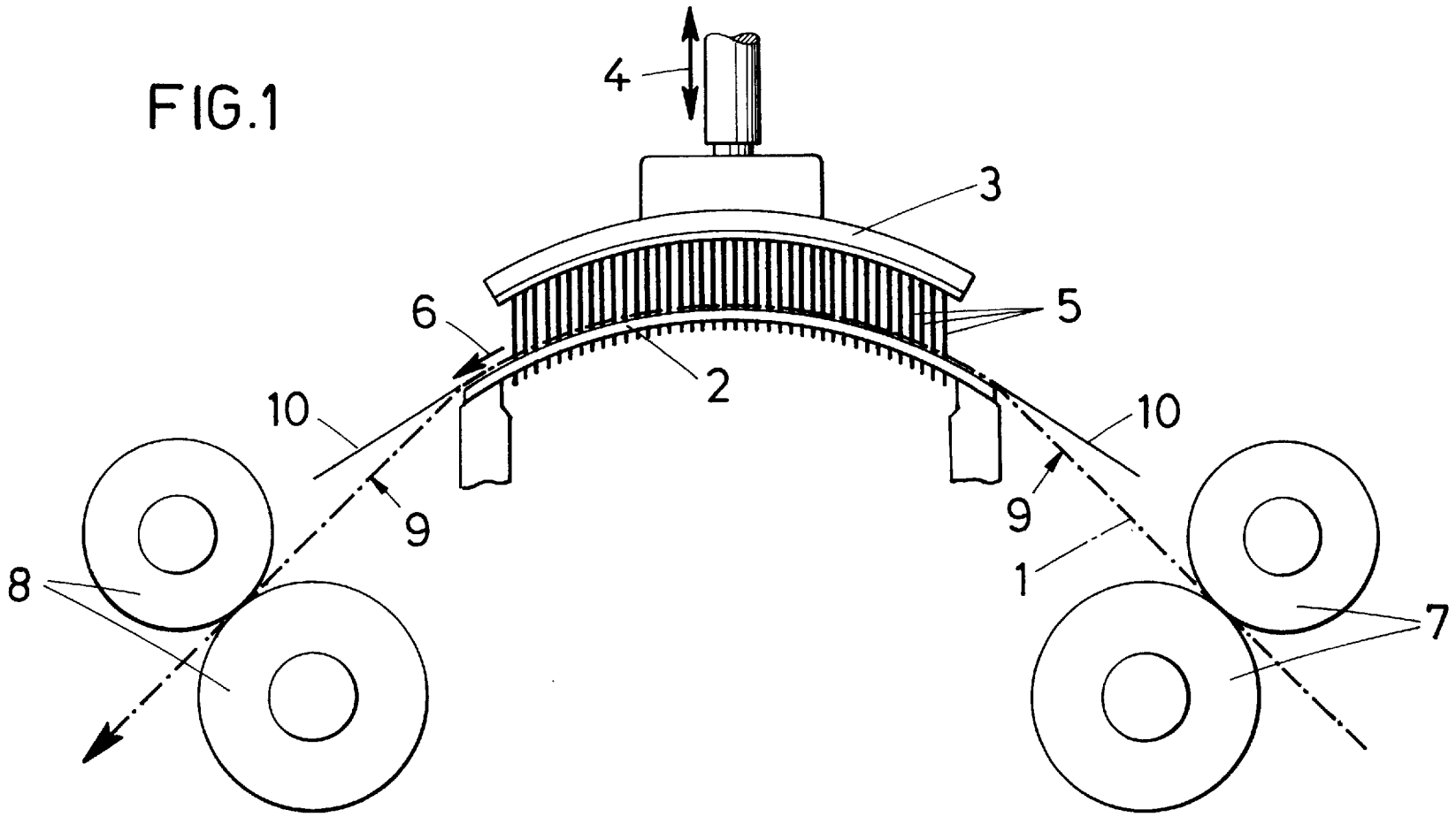
FIG. 1 represents an inventive device for needling a prebonded web in a schematic longitudinal section.

The illustrated device for needling a web 1 in accordance with the embodiment shown in FIG. 1 substantially comprises a stationary web support 2 in the form of a perforated plate, and a needle board 3 disposed directly above the web support 2, which needle board is reciprocatingly movable transverse to the web support 2, as this is indicated by the arrow 4. The needles of the needle board 3 are designated with the reference numeral 5. In contrast to conventional devices of this type there is no stripper between the needle board 3 and the web support 2. Such stripper can be omitted because the web support 2 has a continuous convex curvature in direction of web movement 6, and the web 1 is subjected to a tensile stress between a feed roller 7 and a discharge roller 8, which for this purpose is driven at a larger peripheral speed than the feed roller 7. This tensile stress acting on the web 1 in connection with the convex curvature of the web support 2 produces a compressive force urging the web 1 against the stationary web support 2, so that the occurring normal forces act against the resistance to the withdrawal of the needles 5 from the web 1 with the result that the needles 5 can easily be withdrawn from the web 1 despite the missing stripper. To be able to use needles 5 of equal length, the needle board 3 should likewise be curved, as this is indicated in the drawing. The additional effort of the curved web support 2 and the curved needle board 3 is compensated by the improvement of the web felting as a result of such curvature, because the needles 5 stitch into the web 1 in different directions with respect to said web.

To ensure a close fit of the web also in the inlet and outlet portions of the web support 2, the web passage surfaces 9 extend on the one hand between the web support 2 and the feed roller 7 and on the other hand between the web support 2 and the discharge roller 8 on the side facing away from the needle board 3 with an inclination away from the tangential inlet and outlet planes 10 of the web support 2, which causes a deflection of the web 1 in the vicinity of the inlet and outlet edges of the web support 2, and thus excludes a lifting of the web 1 from the web support 2 in the vicinity of the inlet and outlet edges.

Due to the lack of a conventional stripper between the needle board 3 and the web support 2, there is no restriction of the minimum distance of the needles 5 from each other by the minimum distance of the holes in the perforated plate of the stripper, so that a much larger needle density of, for instance, eleven needles per $cm^2$ can be achieved. In FIG. 2 such considerably denser needle packing as compared to conventional needle boards can easily be seen from the pitch of the receiving bores 11 for the needles 5. The arrangement has been made such that the mutual axial distance of the receiving bores 11 approximately corresponds to 1.6 to 1.7 times the stem diameter of the needles 5. The variations in this axial distance result from the fact that the receiving bores 11 are arranged with an irregular mutual offset transverse to the direction of web movement 6, so as to avoid locally increased stitch densities as a result of a completely regular needle arrangement.

The higher density of the needle distribution of course also prevents the use of a perforated plate as web support 2, as otherwise the restriction of the density of the needle distribution by the distance of the holes in the web support 2 would again have to be accepted. The web support 2 might consist of individual blades arranged with a mutual distance. For needling in particular the web surface it would also be possible to provide an unperforated plate with a continuous smooth surface as web support 2, namely when the needles 5 do not pierce the web 1, as this might be the case with fork-type needles. When for needling a surface needles 5 with barbs 12 are used for the entrainment of fibers in accordance with FIG. 3, care should be taken that the barbs 12 will yet penetrate into the web 1 deep enough. This means a comparatively small distance between the needle tip and the barbs 12, where, however, the web thickness should largely be utilized for the needle stitch. More favorable stitching conditions are obtained in web supports 2 which are provided with surface indentations 13 in the area of extension of the needles 5, as this is indicated in FIG. 3. These surface indentations 13 provide for a larger needle penetration, without impairing the required strength of the web support 2.

I claim:

1. A device for needling a prebonded web, which comprises (a) a feed roller feeding the web at a feed rate in a direction of web movement, (b) a stationary web support having a continuous convex curvature in the direction of web movement, (c) a needle board reciprocatingly movable in a needling direction towards and away from the stationary web support, the needle board being disposed directly opposite the web support, and (d) a discharge roller withdrawing the web at a withdrawal rate exceeding the feed rate, the web support being disposed between the feed roller and the discharge roller.

2. The needling device of claim 1, wherein the surfaces of the web facing away from the needle board between an inlet of the web support and the feed roller, on the one hand, and between an outlet of the web support and the discharge roller, on the other hand, are inclined away from planes extending tangentially to the convex curvature of the web support at the web support inlet and the web support outlet, respectively.

3. The needling device of claim 1, wherein the needle board has at least one area disposed directly opposite the web support and carrying at least five needles per square centimeter inserted in separate bores.

4. The needling device of claim 3, wherein the needle board has at least one area disposed directly opposite the web support and carrying at least eight needles per square centimeter inserted in separate bores.

5. The needling device of claim 1, wherein the needling board carries needles extending in the needling direction, and the web support defines surface indentations in alignment with the needles.

* * * * *